US011430369B2

(12) United States Patent
Zhang

(10) Patent No.: US 11,430,369 B2
(45) Date of Patent: Aug. 30, 2022

(54) DETERMINING METHOD OF GAMMA VALUE AND DEVICE THEREOF, AND DISPLAY TERMINAL

(71) Applicant: HUIZHOU CHINA STAR OPTOELECTRONICS TECHNOLOGY CO., LTD., Huizhou (CN)

(72) Inventor: Yun Zhang, Guangdong (CN)

(73) Assignee: HUIZHOU CHINA STAR OPTOELECTRONICS TECHNOLOGY CO, LTD., Huizhou (CN)

( * ) Notice: Subject to any disclaimer, the term of this patent is extended or adjusted under 35 U.S.C. 154(b) by 196 days.

(21) Appl. No.: 16/770,097

(22) PCT Filed: May 13, 2020

(86) PCT No.: PCT/CN2020/089958
§ 371 (c)(1),
(2) Date: Jun. 5, 2020

(87) PCT Pub. No.: WO2021/212566
PCT Pub. Date: Oct. 28, 2021

(65) Prior Publication Data

US 2022/0114940 A1 Apr. 14, 2022

(30) Foreign Application Priority Data

Apr. 23, 2020 (CN) ..... 202010326848.9

(51) Int. Cl.
*G09G 3/20* (2006.01)

(52) U.S. Cl.
CPC ... *G09G 3/2007* (2013.01); *G09G 2300/0842* (2013.01); *G09G 2320/0626* (2013.01); *G09G 2320/0673* (2013.01)

(58) Field of Classification Search
CPC ..... G09G 3/2007; G09G 2300/0842; G09G 2320/0626; G09G 2320/0673
See application file for complete search history.

(56) References Cited

U.S. PATENT DOCUMENTS

2005/0206587 A1 9/2005 Baek
2016/0260368 A1 9/2016 Zheng
2019/0108780 A1* 4/2019 Meng ..... G09G 3/006
2019/0206345 A1 7/2019 Kang
(Continued)

FOREIGN PATENT DOCUMENTS

CN 104064156 A 9/2014
CN 105280124 A 1/2016
(Continued)

*Primary Examiner* — Chad M Dicke

(57) ABSTRACT

The present invention provides a determining method of a gamma value and a device thereof, and a display terminal. The method includes obtaining a plurality of target gray scales from a gray scale range of a display panel; determining a local gamma value of each of the target gray scales of the plurality of the target gray scales; determining an approximate gamma value of the display panel according to the local gamma value of the plurality of the target gray scales; and determining a gamma value of the display panel according to the approximate gamma value.

8 Claims, 3 Drawing Sheets

(56) References Cited

U.S. PATENT DOCUMENTS

| | | | | |
|---|---|---|---|---|
| 2019/0266968 | A1* | 8/2019 | Wang | G09G 3/2803 |
| 2021/0012700 | A1 | 1/2021 | Ji | |
| 2021/0049966 | A1 | 2/2021 | Hsu et al. | |

FOREIGN PATENT DOCUMENTS

| | | | |
|---|---|---|---|
| CN | 106601167 | A | 4/2017 |
| CN | 107578760 | A | 1/2018 |
| CN | 108231015 | A | 6/2018 |
| CN | 109147708 | A | 1/2019 |
| CN | 109637475 | A | 4/2019 |
| CN | 110473502 | A | 11/2019 |
| CN | 110880295 | A | 3/2020 |
| WO | 2009057889 | A1 | 5/2009 |

* cited by examiner

DETERMINING METHOD OF GAMMA VALUE AND DEVICE THEREOF, AND DISPLAY TERMINAL

CROSS REFERENCE TO RELATED APPLICATIONS

The application claims priority to a Chinese patent application filed on Apr. 23, 2020 in the State Intellectual Property Office (SIPO), having application number 202010326848.9, titled "Determining Method of Gamma Value and Device Thereof, and Display Terminal", and the entire contents of which are incorporated herein by reference.

FIELD OF INVENTION

The present disclosure relates to the field of display technology, and more particularly, to a determining method of a gamma value, and a device thereof, and a display terminal.

BACKGROUND OF INVENTION

Gamma is an important parameter to measure characteristics of display screens. In the prior art, a least squares method is configured to calculate the gamma value, that is, assuming a possible range of the gamma values in advance. For example, assuming a gamma value range ranging from 1 to 3, and obtaining values within a gamma value range according to accuracy of a required gamma value in sequence; for example, if the accuracy of the required gamma value is 0.01, the values are obtained once at every 0.01 interval starting from 1, 1.01, 1.02 as candidate gamma values. Therefore, 201 candidate gamma values need to be obtained, and the 201 candidate gamma values are calculated and compared to determine the gamma values of display panels from the 201 candidate gamma values.

The above method of determining the gamma value needs to be calculated 201 times, which takes a long time and has low efficiency. Moreover, if the gamma value of the display panel is not within the assumed range of 1 to 3, and the above method only searches for gamma values within the range of 1 to 3, this results in an inability to accurately determine the gamma value of the display panel.

SUMMARY OF INVENTION

An embodiment of the present disclosure provides a determining method of a gamma value and a device thereof, and a display terminal to solve the problem of long time consuming, low efficiency, and low accuracy in the prior art.

The determining method of the gamma value provided by the embodiment of the present disclosure comprises: obtaining a plurality of target gray scales from a gray scale range of a display panel; determining a local gamma value of each of the target gray scales of the plurality of the target gray scales; determining an approximate gamma value of the display panel according to the local gamma value of the plurality of the target gray scales; and determining a gamma value of the display panel according to the approximate gamma value.

Furthermore, the step of obtaining the plurality of the target gray scales from the gray scale range of the display panel specifically comprises, within the gray scale range of the display panel, a gray scale is preset at each interval and one of the target gray scales are determined to obtain the plurality of the target gray scales.

Furthermore, the gray scale range of the display panel ranges from 0 to 255, and the preset gray scale of the interval comprises 0 gray scales, 2 gray scales, or 4 gray scales.

Furthermore, wherein the step of determining the local gamma value of each of the target gray scales of the plurality of the target gray scales specifically comprises measuring brightness corresponding to each of the target gray scales of the plurality of the target gray scales, and determining the local gamma value of each of the target gray scales according to the brightness corresponding to each of the target gray scales.

Furthermore, the step of determining the approximate gamma value of the display panel according to the local gamma value of the plurality of the target gray scales specifically comprises calculating an average value of the local gamma value of the plurality of the target gray scales and using the average value as the approximate gamma value of the display panel.

Furthermore, the step of determining the gamma value of the display panel according to the approximate gamma value specifically comprises determining a gamma value range of the display panel according to the approximate gamma value, and determining the gamma value within the gamma value range of the display panel.

Furthermore, the step of determining the gamma value within the gamma value range of the display panel specifically comprises obtaining a plurality of candidate gamma values from the gamma value range, determining a gray scale dispersion corresponding to each candidate gamma value of the plurality of candidate gamma values, and using the candidate gamma value whose gray scale dispersion is closest to a sample gray scale dispersion as the gamma value of the display panel.

A determining device of the gamma value further provided by the embodiment of the present disclosure comprises an obtaining module configured to obtain a plurality of target gray scales from a gray scale range of a display panel, a local gamma value determining module configured to determine the local gamma value of each of the target gray scales of the plurality of the target gray scales, an approximate gamma value determining module configured to determine the approximate gamma value of the display panel according to the local gamma value of the plurality of the target gray scales, and a gamma value determining module configured to determine the gamma value of the display panel according to the approximate gamma value.

Furthermore, the obtaining module is specifically configured to preset a gray scale for each interval and determine one target gray scale to obtain the plurality of the target gray scales within the gray scale range of the display panel.

Furthermore, the gray scale range of the display panel ranges from 0 to 255, and the preset gray scale of the interval comprises 0 gray scales, 2 gray scales, or 4 gray scales.

Furthermore, the local gamma value determining module is specifically configured to measure brightness corresponding to each of the target gray scales of the plurality of the target gray scales, and determine the local gamma value of each of the target gray scales according to the brightness corresponding to each of the target gray scales.

Furthermore, the approximate gamma value determining module is specifically configured to calculate an average value of the local gamma value of the plurality of the target gray scales and using the average value as the approximate gamma value of the display panel.

Furthermore, the gamma value determining module specifically comprises a determining unit of a gamma value range configured to determine the gamma value range of the display panel according to the approximate gamma value, and a determining unit of the gamma value configured to determine the gamma value within the gamma value range of the display panel.

Furthermore, the determining unit of the gamma value is configured to obtain a plurality of candidate gamma values from the gamma value range, determine a gray scale dispersion corresponding to each candidate gamma value of the plurality of candidate gamma values, and use the candidate gamma value whose gray scale dispersion is closest to a sample gray scale dispersion as the gamma value of the display panel.

A display terminal further provided by the embodiment of the present disclosure comprises a processor and a memory unit. The memory unit is configured to store instructions and data, and the processor is configured to perform a plurality of steps as follows: obtaining a plurality of target gray scales from a gray scale range of a display panel; determining a local gamma value of each of the target gray scales of the plurality of the target gray scales; determining an approximate gamma value of the display panel according to the local gamma value of the plurality of the target gray scales; and determining a gamma value of the display panel according to the approximate gamma value.

Furthermore, the step of obtaining the plurality of the target gray scales from the gray scale range of the display panel specifically comprises, within the gray scale range of the display panel, a gray scale is preset at each interval and one of the target gray scales are determined to obtain the plurality of the target gray scales.

Furthermore, wherein the step of determining the local gamma value of each of the target gray scales of the plurality of the target gray scales specifically comprises measuring brightness corresponding to each of the target gray scales of the plurality of the target gray scales, and determining the local gamma value of each of the target gray scales according to the brightness corresponding to each of the target gray scales.

Furthermore, the step of determining the approximate gamma value of the display panel according to the local gamma value of the plurality of the target gray scales specifically comprises calculating an average value of the local gamma value of the plurality of the target gray scales and using the average value as the approximate gamma value of the display panel.

Furthermore, the step of determining the gamma value of the display panel according to the approximate gamma value specifically comprises determining a gamma value range of the display panel according to the approximate gamma value, and determining the gamma value within the gamma value range of the display panel.

Furthermore, the step of determining the gamma value within the gamma value range of the display panel specifically comprises obtaining a plurality of candidate gamma values from the gamma value range, determining a gray scale dispersion corresponding to each candidate gamma value of the plurality of candidate gamma values, and using the candidate gamma value whose gray scale dispersion is closest to a sample gray scale dispersion as the gamma value of the display panel.

Beneficial effects of the present disclosure are that determining the plurality of the target gray scales within the gray scale range of the display panel, and determining the local gamma value of each of the target gray scales, and determining the approximate gamma value of the display panel according to the local gamma value of the plurality of the target gray scales to determine the gamma value of the display panel based on the approximate gamma value, thereby narrowing and accurately defining the gamma value range, saving a determining time of the gamma value, and improving determining efficiency and determining accuracy of the gamma value.

DESCRIPTION OF DRAWINGS

The detailed description of specific embodiments of the present disclosure will make technical solutions and other beneficial effects of the present disclosure obvious in the following with reference to the drawings.

DETAILED DESCRIPTION OF PREFERRED EMBODIMENTS

Figure 1:
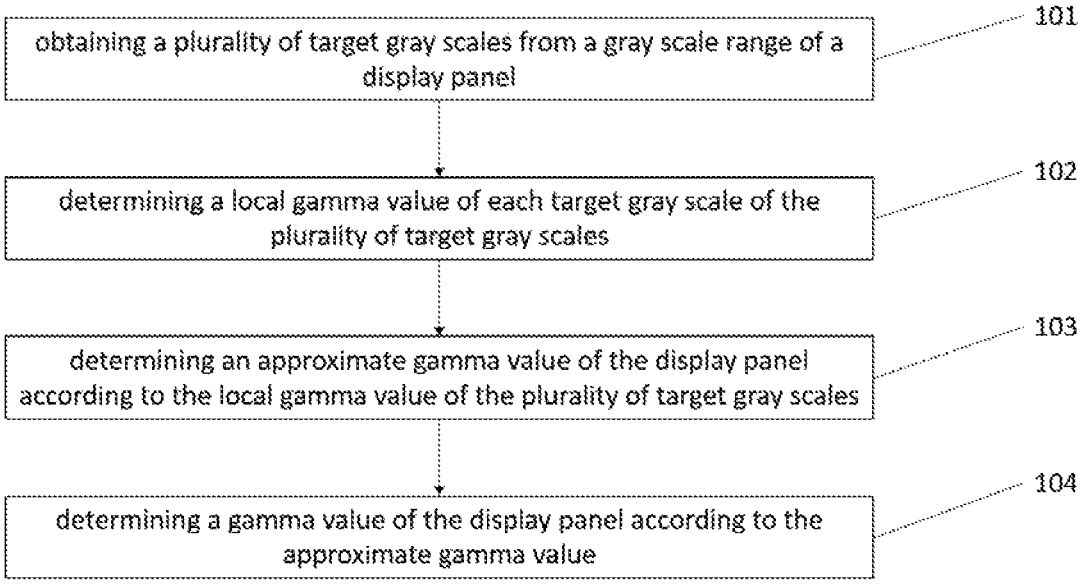
FIG. 1 is a flowchart of a determining method of a gamma value provided by an embodiment of the present disclosure.

The specific structural and functional details disclosed herein are merely representative and are for a purpose of describing exemplary embodiments of the present disclosure. However, the present disclosure can be implemented in many alternative forms, and should not be interpreted as being limited to the embodiments set forth herein.

In descriptions of the present disclosure, it should be noted that, orientations or position relationships indicated by the terms, such as "center", "upper", "lower", "front", "back", "left", "right", "vertical", "horizontal", "top", "bottom", "inside", "outside", etc. are based on the orientations or position relationships shown in the drawings. These are only convenience for describing the present disclosure and simplifying the descriptions, and does not indicate or imply that the device or element must have a specific orientation, a structure and an operation in the specific orientation, so it cannot be understood as a limitation on the present disclosure. In addition, the terms "first" and "second" are used for describing purposes only, and cannot be understood as indicating or implying relative importance or implicitly indicating the number of technical features indicated. Thus, the features defined as "first" and "second" may explicitly or implicitly include one or more of the features. In the descriptions of the present disclosure, the meaning of "plurality" is two or more. In addition, the term "comprising" and any variations thereof are intended to cover non-exclusive inclusions.

In the present disclosure, the terms "mounting", "connected", "fixed" and the like should be broadly understood unless expressly stated or limited otherwise. For example, it may be fixed connected, removably connected, or integrated; it may be mechanically connected, or an electrically connected; it may be directly connected, or indirectly connected through an intermediary; it may be a connection between two elements or an interaction between two elements. For those skilled in the art, the specific meanings of the above terms in the present disclosure may be understood based on specific situations.

The terminology used herein is for describing specific embodiments only and is not intended to limit exemplary embodiments. Unless the context clearly indicates otherwise, the singular forms "a" and "an" as used herein are also intended to include the plural. It should also be understood that the terms "including" and/or "comprising" as used herein specify the presence of stated features, integers, steps, operations, units, and/or components, and do not exclude the presence or addition of one or more other features, integers, steps, operations, units, components, and/or combinations thereof.

The present disclosure will be further described below with reference to the drawings and embodiments.

As shown in FIG. 1, a determining method of a gamma value provided by an embodiment of the present disclosure comprises:

Step 101: obtaining a plurality of target gray scales from a gray scale range of a display panel.

In the present embodiment, different display panels have different gray scale ranges; for example, an 8-bit display panel has a 256-level gray scale with a gray scale range of 0 to 255, and a 10-bit display panel has a 1024-level gray scale with a gray scale range of 0 to 1023. After determining the gray scale range of the display panel, an entirety of or a part of the gray scale from the gray scale range can be selected as the target gray scale.

Specifically, the step 101 of obtaining the plurality of the target gray scales from the gray scale range of the display panel comprises within the gray scale range of the display panel, a gray scale is preset at each interval and one of the target gray scales are determined to obtain the plurality of the target gray scales.

It should be noted that, within the gray scale range of the display panel, first determine a minimum gray scale of the gray scale range as the target gray scale, and then start from the minimum gray scale and preset the gray scale each interval to determine one target gray scale. Whether the target gray scale interval determined by a last detection has a maximum gray scale in the gray scale range, if not, the maximum gray scale in the gray scale range can be determined as the target gray scale.

Wherein, a preset gray scale of the interval can be 0 gray scales, that is, all gray scales in the gray scale range are determined as the target gray scale; for example, the gray scale range ranges from 0 to 255, then 0 to 255 gray scales are determined as the target gray scale. The preset gray scale of the interval can also be a positive integer, that is, a part of gray scales within the gray scale range is uniformly selected as the target gray scale; for example, the gray scale range ranges from 0 to 255, and the preset gray scale of the interval can be 2 or 4 gray scales. The larger the preset gray scale of the interval, the greater a deviation of a subsequent calculation of the gamma value. However, it can be seen from an experiment that when the preset gray scale of the interval is 2 or 4 gray scales, the deviation of the gamma value is extremely small and can be ignored. If the preset gray scale of the interval is 4 gray scales, 0, 4, 8, 12, . . . , 248, 252 gray scales are determined as the target gray scale, and the maximum gray scale 255 of the gray scale range is determined as the target gray scale. The interval method determining the target gray scale can reduce the number of subsequent processing target gray scales, save processing time, thereby improving determining efficiency of the gamma value.

Step 102: determining a local gamma value of each of the target gray scales of the plurality of the target gray scales.

In the present embodiment, after determining the plurality of the target gray scales, the local gamma value of each of the target gray scales must be calculated. Specifically, the step 102 of determining the local gamma value of each of the target gray scales of the plurality of the target gray scales specifically comprises measuring brightness corresponding to each of the target gray scales of the plurality of the target gray scales, and determining the local gamma value of each of the target gray scales according to the brightness corresponding to each of the target gray scales.

It should be noted that the brightness of each of the target gray scales is first measured using a brightness meter; for example, the plurality of the target gray scales comprises 0 to 255 gray scales, and the brightness of 0 to 255 gray scales are measured, namely $L_0$, $L_1$, $L_2$, . . . , $L_{253}$, $L_{254}$, $L_{255}$. Therefore, the local gamma value of the corresponding target gray scale is calculated according to brightness corresponding to each of the target gray scales, and the maximum target gray scale and the corresponding brightness in the plurality of the target gray scales. For example, the plurality of the target gray scales comprises 0 to 255 gray scales, and the maximum target gray scale is 255, that is, for a target gray scale n, a local gamma value of the target gray scale n is calculated according to brightness corresponding to the target gray scale n, and the maximum target gray scale 255 and the corresponding brightness $L_{255}$ in the plurality of the target gray scales, wherein the local gamma value is calculated by a logarithmic calculation, a specific calculation formula is $\mathrm{Log}_{L_n/L_{255}}{}^{n/255}$.

Step 103: determining an approximate gamma value of the display panel according to the local gamma value of the plurality of the target gray scales.

In the present embodiment, after determining the local gamma value of each of the target gray scales, the gamma value of the display panel can be preliminarily determined by combining the local gray scale values of all target gray scales, the preliminary determined gamma value is the approximate gamma value, that is, there is a certain error.

Specifically, the step 103 of determining the approximate gamma value of the display panel according to the local gamma value of the plurality of the target gray scales specifically comprises calculating an average value of the local gamma value of the plurality of the target gray scales and using the average value as the approximate gamma value of the display panel.

It should be noted that the local gamma values of all target gray scales are added and averaged; for example, the plurality of the target gray scales comprises 0 to 255 gray scales, the local gamma values from 0 to 255 gray scales are added and averaged. The average value is the approximate gamma value of the display panel, and the approximate gamma value has a certain error. In order to accurately determine the gamma value of the display panel, step 104 needs to be continued.

Step 104: determining a gamma value of the display panel according to the approximate gamma value.

In the present embodiment, since the approximate gamma value has the certain error in, the gamma value of the display panel can be accurately determined based on the approximate gamma value and considering possible errors.

Specifically, the step of determining the gamma value of the display panel according to the approximate gamma value specifically comprises determining a gamma value range of the display panel according to the approximate gamma value, and determining the gamma value within the gamma value range of the display panel.

It should be noted that, the gamma value range of the display panel can be determined considering the possible errors of the approximate gamma value. Since an error of the approximate gamma value is small, generally within ±0.1, the gamma value range of the display panel is determined within Value±0.1, wherein Value is the approximate gamma value. After determining the gamma value range, the gamma value of the display panel can be determined from the gamma value range. The present embodiment accurately reduces the gamma value range assumed in the prior art to within Value±0.1, effectively improving the determining efficiency and determining accuracy of the gamma value.

Furthermore, the step of determining the gamma value within the gamma value range of the display panel specifically comprises obtaining a plurality of candidate gamma values from the gamma value range, determining a gray scale dispersion corresponding to each candidate gamma value of the plurality of candidate gamma values, and using the candidate gamma value whose gray scale dispersion is closest to a sample gray scale dispersion as the gamma value of the display panel.

It should be noted that the candidate gamma value can be obtained according to accuracy of a required gamma value; for example, the approximate gamma value Value is 3, the gamma value range ranges from 2.9 to 3.1, the accuracy of the required gamma value is 0.01, and the plurality of candidate gamma values can comprise 2.90, 2.91, 2.92, . . . , 3.00, 3.01, 3.02, . . . , 3.09, 3.10, that is, when the accuracy of the required gamma value is 0.01, 21 candidate gamma values may be obtained from the gamma value range, and the gamma value of the display panel is determined from the 21 candidate gamma values.

Figure 2:
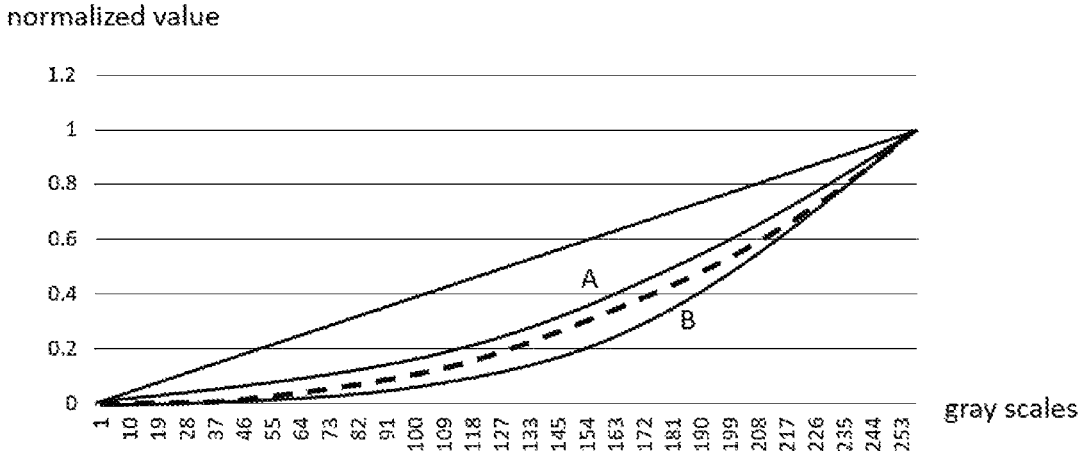
FIG. 2 is a standard curve diagram of different candidate gamma values in the determining method of the gamma value provided by the embodiment of the present disclosure.

Specifically, in the plurality of candidate gamma values, for each candidate gamma value, a normalized value corresponding to each of the target gray scales is calculated; for example, when the plurality of the target gray scales comprise 0 to 255, for an i-th candidate gamma value Gi, a normalized value corresponding to the target gray scale n is $(n/255)^{Gi}$, and a standard curve of the i-th candidate gamma value Gi can be obtained according to each of the target gray scales n and the corresponding normalized value. For example, as shown in FIG. 2, a solid line A is a standard curve of a candidate gamma value of 2.95, a solid line B is a standard curve of a candidate gamma value of 3.00, and a dotted line is a sample standard curve. It should be noted that FIG. 2 does not list standard curves of all candidate gamma values.

Furthermore, a least square method is configured to calculate the gray scale dispersion corresponding to each candidate gamma value; for example, when the plurality of the target gray scales comprise 0 to 255, the gray scale dispersion corresponding to the i-th candidate gamma value Gi is $$\sum_{0\to 255}\left(\frac{L_n}{L_{255}}-\left(\frac{n}{255}\right)^{Gi}\right)^2.$$

A difference between the gray scale dispersion corresponding to each candidate gamma value and the sample gray scale dispersion are separately calculated to determine the candidate gamma value with a minimum difference, and the candidate gamma value with the minimum difference is used as the gamma value of the display panel.

The embodiment of the present disclosure can determine the plurality of the target gray scales within the gray scale range of the display panel, and determine the local gamma value of each of the target gray scales, and determine the approximate gamma value of the display panel according to the local gamma value of the plurality of the target gray scales to determine the gamma value of the display panel based on the approximate gamma value, thereby narrowing and accurately defining the gamma value range, saving a determining time of the gamma value, and improving determining efficiency and determining accuracy of the gamma value.

Correspondingly, the embodiment of the present disclosure further provides a determining device of the gamma value, which realizes all processes of the determining method of the gamma value in the above embodiments.

Figure 3:
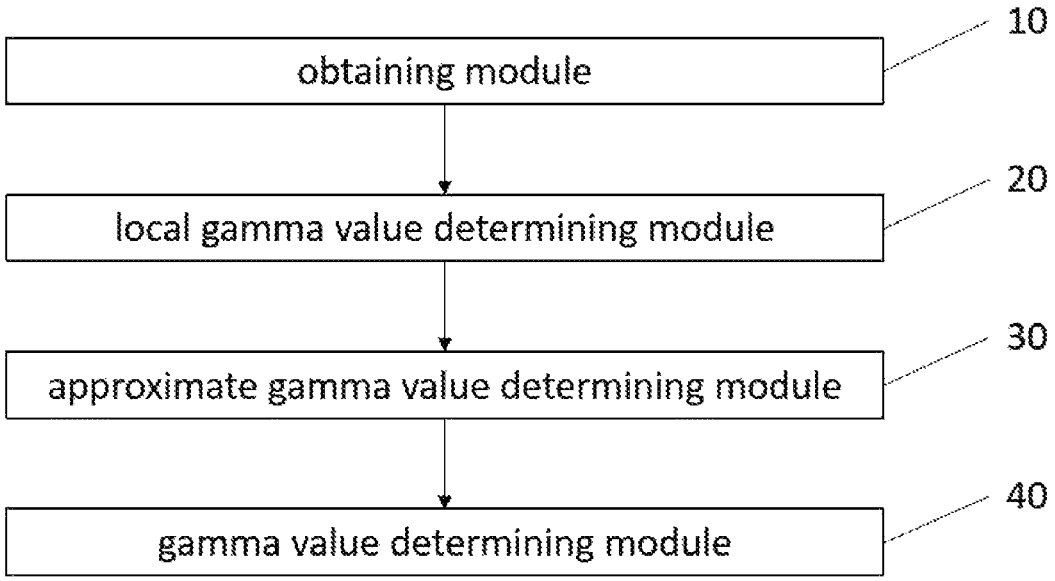
FIG. 3 is a schematic structural diagram of a determining device of the gamma value provided by the embodiment of the present disclosure.

As shown in FIG. 3, the determining device of the gamma value provided by the embodiment of the present disclosure comprises: an obtaining module 10 configured to obtain the plurality of the target gray scales from the gray scale range of the display panel; a local gamma value determining module 20 configured to determine the local gamma value of each of the target gray scales of the plurality of the target gray scales; an approximate gamma value determining module 30 configured to determine the approximate gamma value of the display panel according to the local gamma value of the plurality of the target gray scales; and a gamma value determining module 40 configured to determine the gamma value of the display panel according to the approximate gamma value.

Furthermore, the obtaining module 10 is specifically configured to preset a gray scale for each interval and determine one target gray scale to obtain the plurality of the target gray scales within the gray scale range of the display panel.

Furthermore, the gray scale range of the display panel ranges from 0 to 255, and the preset gray scale of the interval comprises 0 gray scales, 2 gray scales, or 4 gray scales.

Furthermore, the local gamma value determining module 20 is specifically configured to measure brightness corresponding to each of the target gray scales of the plurality of the target gray scales, and determine the local gamma value of each of the target gray scales according to the brightness corresponding to each of the target gray scales.

Furthermore, the approximate gamma value determining module 30 is specifically configured to calculate an average value of the local gamma value of the plurality of the target gray scales and using the average value as the approximate gamma value of the display panel.

Furthermore, the gamma value determining module 40 specifically comprises a determining unit of a gamma value range configured to determine the gamma value range of the display panel according to the approximate gamma value, and a determining unit of the gamma value configured to determine the gamma value within the gamma value range of the display panel.

Furthermore, the determining unit of the gamma value is configured to obtain a plurality of candidate gamma values from the gamma value range, determine a gray scale dispersion corresponding to each candidate gamma value of the plurality of candidate gamma values, and use the candidate gamma value whose gray scale dispersion is closest to a sample gray scale dispersion as the gamma value of the display panel.

The embodiment of the present disclosure can determine the plurality of the target gray scales within the gray scale range of the display panel, and determine the local gamma value of each of the target gray scales, and determine the approximate gamma value of the display panel according to the local gamma value of the plurality of the target gray scales to determine the gamma value of the display panel based on the approximate gamma value, thereby narrowing and accurately defining the gamma value range, saving a determining time of the gamma value, and improving determining efficiency and determining accuracy of the gamma value.

Figure 4:
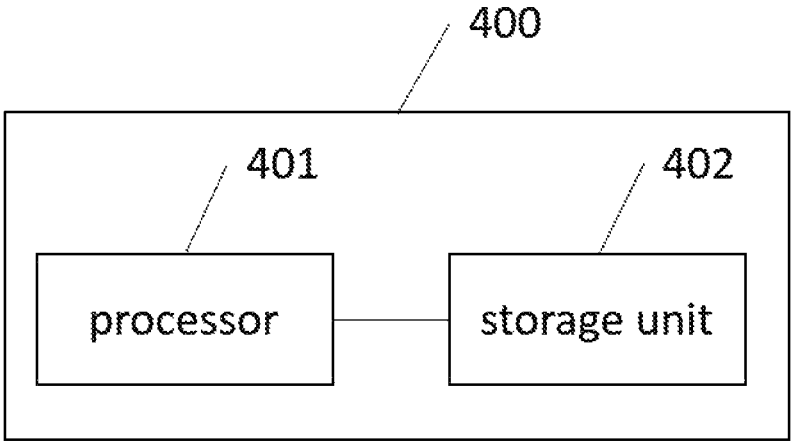
FIG. 4 is a schematic structural diagram of a display terminal provided by the embodiment of the present disclosure.

In addition, the embodiment of the present disclosure further provides a display terminal, and the display terminal may be a smart phone, a tablet computer, or TV, etc. As shown in FIG. 4, the display terminal 400 comprises a processor 401 and a memory unit 402, wherein the processor 401 and the memory unit 402 are electrically connected.

The processor 401 is a control center of the display terminal 400, and uses various interfaces and lines to connect various parts of the entire display terminal, which performs various functions of the display terminal and process data by running or loading application programs stored in the memory unit 402 and recalling data stored in the memory unit 402, to monitor the entire display terminal.

In the present embodiment, the processor 401 in the display terminal 400 will follow a plurality of steps as follows which load instructions corresponding to a process of one or more application programs into the memory unit 402, and execute the application programs stored in the memory unit 402 by the processor 401, thereby realizing various functions:

Obtaining the plurality of the target gray scales from the gray scale range of the display panel; determining the local gamma value of each of the target gray scales of the plurality of the target gray scales; determining the approximate gamma value of the display panel according to the local gamma value of the plurality of the target gray scales; and determining the gamma value of the display panel according to the approximate gamma value.

Figure 5:
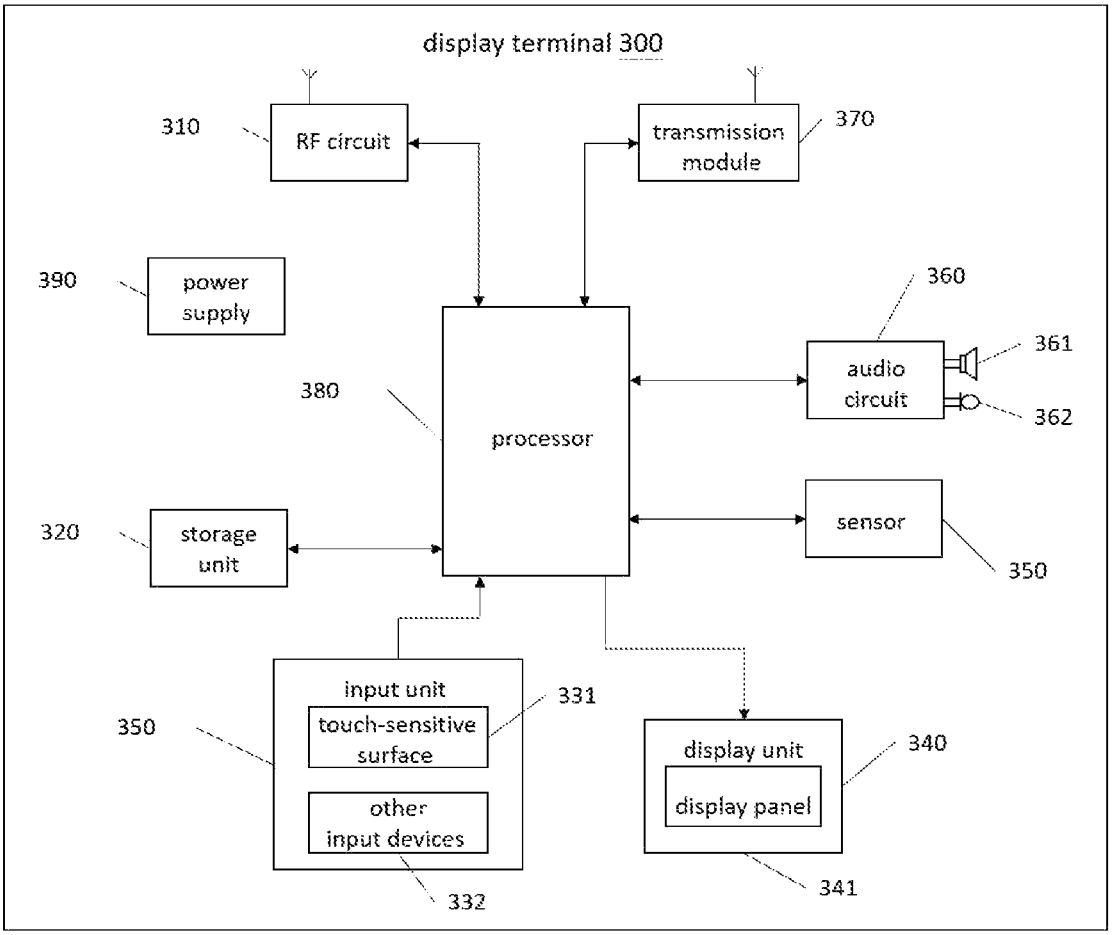
FIG. 5 is the other schematic structural diagram of the display terminal provided by the embodiment of the present disclosure.

Refer to FIG. 5, FIG. 5 is the other schematic structural diagram of the display terminal provided by the embodiment of the present disclosure. The display terminal 300 may comprises a radio frequency (RF) circuit 310, a memory unit 320 comprising one or more computer-readable storage media, an input unit 330, a display unit 340, a sensor 350, an audio circuit 360, a speaker 361, a microphone 362, a transmission module 370, a processor 380 comprising one or more processing cores, a power supply 390, and other components.

Those skilled in the art can understand that a structure of the display terminal shown in FIG. 5 does not constitute a limitation on the display terminal, and may include more or less components than the illustration, or combine some components, or arrange different components.

The RF circuit is configured to receive and transmit electromagnetic waves, realize a mutual conversion of electromagnetic waves and electrical signals, thereby communicating with a communication network or other equipment. The RF circuit 310 may comprise various current circuit elements for performing the functions; for example, an antenna, a radio frequency transceiver, a digital signal processor, an encryption/decryption chip, a subscriber identity module (SIM) card, a memory unit, etc. The RF circuit 310 can communicate with various networks such as Internet, intranet, and wireless network, or communicate with other devices through the wireless network. The above wireless network may comprise a cellular telephone network, a wireless local area network, or a metropolitan area network. The above wireless network can use various communication standards, protocols, and technologies, comprising but not limited to Global System for Mobile Communication (GSM), Enhanced Data GSM Environment (EDGE), Wideband Code Division Multiple Access (WCDMA), Code Division Access (CDMA), Time Division Multiple Access (TDMA), Wireless Fidelity (Wi-Fi) such as Institute of Electrical and Electronics Engineers (IEEE) standard IEEE 802.11a, IEEE 802.11b, IEEE802.11g, and/or IEEE 802.11n, Voice over Internet Protocol (VoIP), Worldwide Interoperability for Microwave Access (Wi-Max), other protocols for mail, instant messaging and short messages, any other suitable communication protocols, and may even comprise those that have not yet been developed.

The memory unit 320 may be configured to store software programs and modules, and the processor 380 executes various functional applications and data processing by running the software programs and the modules stored in the memory unit 320, thereby realizing a function of automatic fill light when taking photos with a front camera. The memory unit 320 may comprise a high-speed random memory unit, and may further comprise a non-volatile memory unit, such as one or more magnetic storage devices, flash memory, or other non-volatile solid-state memory unit. In some embodiments, the memory unit 320 may further comprise memory units remotely disposed corresponding to the processor 380, and the remote memory units may be connected to the display terminal 300 through a network. The above embodiments of the networks comprise but are not limited to the Internet, intranets, local area networks, mobile communication networks, and combinations thereof.

The input unit 330 can be configured to receive input digital or character information, and generate keyboard, mouse, joystick, and optical or trackball signal input related to user settings and function control. Specifically, the input unit 330 may comprise a touch-sensitive surface 331 and other input devices 332. The touch-sensitive surface 331, also known as a touch screen or touch pad, can collect user's touch operations on or near it (such as user's operations on or near touch-sensitive surface 331 using any suitable objects or accessories such as fingers, stylus, etc.), and drive the corresponding connection device according to a preset program. Moreover, the touch-sensitive surface 331 may comprise a touch detection device and a touch controller, wherein the touch detection device detects user's touch orientation and detects signals from the touch operations, and transmits the signals to the touch controller. The touch controller receives touch information from the touch detection device, the touch information is converted into contact coordinates and sent to the processor 380, and the touch controller can receive and execute commands sent by the processor 380. In addition, the touch controller can use a variety of types such as resistive, capacitive, infrared, and surface acoustic waves to realize the touch-sensitive surface 331. In addition to the touch-sensitive surface 331, the input unit 330 may also comprise other input devices 332. Specifically, other input devices 332 may comprise but are not limited to one or more of a physical keyboard, function keys (such as volume control keys, switch keys, etc.), trackball, mouse, or joystick, etc.

The display unit 340 may be configured to display information input by users or provided to the users, and various graphical user interfaces of the display terminal 300, and the graphical user interfaces can consist of graphics, text, icons, video, or any combination thereof. The display unit 340 may comprise a display panel 341, and the display panel 341 may be configured in a form of a liquid crystal display (LCD), an organic light-emitting diode (OLED), etc. Furthermore, the touch-sensitive surface 331 can cover the display panel 341. When the touch-sensitive surface 331 detects the touch operation on or near it, the touch operation is transmitted to the processor 380 to determine a type of touch event, and the processor 380 provides a corresponding visual output on the display panel 341 according to the type of touch event. Although in FIG. 5, the touch-sensitive surface 331 and the display panel 341 are implemented as two independent components to realize input and output functions, in some embodiments, the touch-sensitive surface 331 and the display panel 341 can be integrated to realize input and output functions.

The display terminal 300 may further comprise at least one sensor 350, such as a light sensor, a motion sensor, and other sensors. Specifically, the light sensor may comprise an ambient light sensor and a proximity sensor, wherein the ambient light sensor can adjust brightness of the display panel 341 according to brightness of the ambient light, and the proximity sensor can turn off the display panel 341 and/or the backlight when the display terminal 300 moves near a user's ear. For certain types of motion sensor, a gravity acceleration sensor can detect a magnitude of acceleration in various directions (generally three axes), and can detect a magnitude and directions of gravity when at rest, which can be used for applications that recognize mobile phone gestures (such as horizontal and vertical screen switching, related games, magnetometer attitude calibration), and vibration recognition related functions (such as pedometer, tap). The display terminal 300 can also be configured with other sensors such as gyroscopes, barometers, hygrometers, thermometers, and infrared sensors, which will not be described here.

For the audio circuit 360, the speaker 361, and the microphone 362, the microphone 362 may provide an audio interface between the user and the display terminal 300. The audio circuit 360 can transmit received electrical signals into electrical signals after conversion to the speaker 361, and the speakers 361 are converted into sound signals for output. On the other hand, the microphone 362 converts the collected sound signals into electric signals, the electrical signals are received by the audio circuit 360 and converted into audio data, the audio data is processed by the processor 380, and sent to another terminal through the RF circuit 310, or the audio data is output to the memory unit 320 for further processing. The audio circuit 360 may also comprise an earplug jack to provide communication between the peripheral headset and the display terminal 300.

The display terminal 300 can help users send and receive e-mails, browse web pages, and access streaming media through the transmission module 370 (such as a Wi-Fi module), which provides users with wireless broadband Internet access. Although the transmission module 370 is shown in the figure, it can be understood that it is not a necessary component of the display terminal 300, and can be omitted without changing a scope of essence of the invention as needed.

The processor 380 is the control center of the display terminal 300, and uses various interfaces and lines to connect various parts of an entire mobile phone, which performs various functions of the display terminal and process data by running or loading application programs stored in the memory unit 320 and recalling data stored in the memory unit 320, to monitor the entire mobile phone. Moreover, the processor 380 may comprise one or more processing cores. In some embodiments, the processor 380 may integrate an application processor and a modem processor, wherein the application processor mainly deals with an operating system, user interface, and application programs, etc., and the modem processor mainly deals with wireless communication. It can be understood that the above modem processor may not be integrated into the processor 380.

The display terminal 300 also comprises the power supply 390 (such as a battery) that supplies power to various components. In some embodiments, the power supply can be logically connected to the processor 380 through a power management system, thereby realizing functions such as charging, discharging, and power consumption management through the power management system. The power supply 390 may also comprise any component such as one or more direct current or alternating current power supplies, recharging systems, power failure detection circuits, power converters or inverters, power status indicators, etc.

Although not shown, the display terminal 300 may further comprise a camera (such as a front-facing camera, a rear-facing camera), a Bluetooth module, etc., which will not be described here. Specifically, in the present embodiment, the display unit of the display terminal is a touch screen display device, and display terminal also comprises the memory unit and one or more programs, wherein the one or more of the programs are stored in the memory unit and are configured to be executed by one or more processors to execute one or more programs containing instructions for performing the following operations: obtaining the plurality of the target gray scales from the gray scale range of the display panel; determining the local gamma value of each of the target gray scales of the plurality of the target gray scales; determining the approximate gamma value of the display panel according to the local gamma value of the plurality of the target gray scales; and determining the gamma value of the display panel according to the approximate gamma value.

In specific embodiment, the above modules can be implemented as independent entities, or they can be combined in any combination to be implemented as the same entity or several entities. For the specific embodiment of the above modules, refer to the above method embodiments, which will not be described here.

Those of ordinary skill in the art can understand that all or part of the steps in the various methods of the above embodiments may be completed by instructions, or by controlling a related hardware by instructions, and the instructions can be stored in a computer-readable storage medium and loaded and executed by the processor. Thus, the embodiment of the present disclosure provides a storage medium in which a plurality of instructions are stored, and the instructions can be loaded by the processor to perform any step in the determining method of the gamma value provided by the embodiment of the present disclosure.

Wherein, the storage medium may comprise a read only memory (ROM), a random access memory (RAM), a magnetic disk, or an optical disk, etc. Due to the instructions stored in the storage medium, any step in the determining method of the gamma value provided by the embodiment of the present disclosure may be performed. Therefore, beneficial effects that can be realized by one of the determining methods of the gamma value provided by the embodiments of the present disclosure. For details, refer to the above embodiments, which will not be described here.

Refer to the above embodiments for the specific embodiments of the above operations, which will not be described here.

What is claimed is:

1. A determining method of a gamma value, comprising:

obtaining a plurality of target gray scales from a gray scale range of a display panel;

determining a local gamma value of each of the target gray scales;

determining an approximate gamma value of the display panel according to the local gamma value of the target gray scales; and determining a gamma value of the display panel according to the approximate gamma value;

wherein the step of determining the local gamma value of each of the target gray scales comprises:

measuring brightness corresponding to each of the target gray scales; and calculating the local gamma value of each of the target gray scales according to the brightness corresponding to each of the target gray scales;

wherein the step of determining the approximate gamma value of the display panel according to the local gamma value of the target gray scales comprises:

calculating an average value of the local gamma value of the target gray scales and using the average value as the approximate gamma value of the display panel; and wherein the step of determining the gamma value of the display panel according to the approximate gamma value comprises:

setting a gamma value range of the display panel according to the approximate gamma value and an error of the approximate gamma value;

obtaining a plurality of candidate gamma values from the gamma value range;

calculating a gray scale dispersion corresponding to each of the candidate gamma values; and using a candidate gamma value having a gray scale dispersion closest to a sample gray scale dispersion as the gamma value of the display panel.

2. The determining method of the gamma value as claimed in claim 1, wherein the step of obtaining the target gray scales from the gray scale range of the display panel comprises:

within the gray scale range of the display panel, obtaining the target gray scales by selecting each of the target gray scales at a preset gray scale interval.

3. The determining method of the gamma value as claimed in claim 2, wherein the gray scale range of the display panel ranges from 0 to 255, and the preset gray scale interval is 2 gray scales or 4 gray scales.

4. A determining device of a gamma value, comprises:

an obtaining module configured to obtain a plurality of target gray scales from a gray scale range of a display panel;

a local gamma value determining module configured to determine a local gamma value of each of the target gray scales;

an approximate gamma value determining module configured to determine an approximate gamma value of the display panel according to the local gamma value of the target gray scales; and a gamma value determining module configured to determine a gamma value of the display panel according to the approximate gamma value;

wherein the local gamma value determining module is configured to measure brightness corresponding to each of the target gray scales and calculate the local gamma value of each of the target gray scales according to the brightness corresponding to each of the target gray scales;

wherein the approximate gamma value determining module is configured to calculate an average value of the local gamma value of the target gray scales and use the average value as the approximate gamma value of the display panel; and wherein the gamma value determining module comprises:

a determining unit of a gamma value range configured to set the gamma value range of the display panel according to the approximate gamma value and an error of the approximate gamma value; and a determining unit of the gamma value configured to obtain a plurality of candidate gamma values from the gamma value range, calculate a gray scale dispersion corresponding to each of the candidate gamma values, and use a candidate gamma value having a gray scale dispersion closest to a sample gray scale dispersion as the gamma value of the display panel.

5. The determining device of the gamma value as claimed in claim 4, wherein the obtaining module is configured to select each of the target gray scales at a preset gray scale interval within the gray scale range of the display panel to obtain the target gray scales.

6. The determining device of the gamma value as claimed in claim 5, wherein the gray scale range of the display panel ranges from 0 to 255, and the preset gray scale interval is 2 gray scales or 4 gray scales.

7. A display terminal, comprising a processor and a memory unit, wherein the memory unit is configured to store instructions and data, and the processor is configured to perform a plurality of following steps:

obtaining a plurality of target gray scales from a gray scale range of a display panel;

determining a local gamma value of each of the target gray scales;

determining an approximate gamma value of the display panel according to the local gamma value of the target gray scales; and determining a gamma value of the display panel according to the approximate gamma value;

wherein the step of determining the local gamma value of each of the target gray scales comprises:

measuring brightness corresponding to each of the target gray scales; and calculating the local gamma value of each of the target gray scales according to the brightness corresponding to each of the target gray scales;

wherein the step of determining the approximate gamma value of the display panel according to the local gamma value of the target gray scales comprises:

calculating an average value of the local gamma value of the target gray scales and using the average value as the approximate gamma value of the display panel; and wherein the step of determining the gamma value of the display panel according to the approximate gamma value comprises:

setting a gamma value range of the display panel according to the approximate gamma value and an error of the approximate gamma value;

obtaining a plurality of candidate gamma values from the gamma value range;

calculating a gray scale dispersion corresponding to each of the candidate gamma values; and using a candidate gamma value having a gray scale dispersion closest to a sample gray scale dispersion as the gamma value of the display panel.

8. The display terminal as claimed in claim 7, wherein the step of obtaining the target gray scales from the gray scale range of the display panel comprises:

within the gray scale range of the display panel, obtaining the target gray scales by selecting each of the target gray scales at a preset gray scale interval.

* * * * *